US012037722B2

(12) United States Patent
Osnato

(10) Patent No.: US 12,037,722 B2
(45) Date of Patent: Jul. 16, 2024

(54) TOY LOOM

(71) Applicant: WeCool Toys Inc., Point Pleasant, NJ (US)

(72) Inventor: Jeffrey Osnato, Medford, NJ (US)

(73) Assignee: WeCool Toys Inc., Point Pleasant, NJ (US)

( * ) Notice: Subject to any disclaimer, the term of this patent is extended or adjusted under 35 U.S.C. 154(b) by 109 days.

(21) Appl. No.: 17/810,368

(22) Filed: Jul. 1, 2022

(65) Prior Publication Data

US 2022/0333281 A1 Oct. 20, 2022

Related U.S. Application Data

(63) Continuation of application No. PCT/US2020/067657, filed on Dec. 31, 2020.

(60) Provisional application No. 63/009,724, filed on Apr. 14, 2020, provisional application No. 62/956,937, filed on Jan. 3, 2020.

(51) Int. Cl.

| | |
|---|---|
| ***D03D 29/00*** | (2006.01) |
| ***A63H 33/30*** | (2006.01) |
| ***D07B 3/02*** | (2006.01) |

(52) U.S. Cl.

CPC ..... *D03D 29/00* (2013.01); *A63H 33/30* (2013.01); *D07B 3/02* (2013.01)

(58) Field of Classification Search

CPC ..... D03D 29/00; A63H 33/30; D07B 3/02; D07B 3/14; A44C 5/0053; A44C 27/00; D04C 7/00

See application file for complete search history.

(56) References Cited

U.S. PATENT DOCUMENTS

| | | | | |
|---|---|---|---|---|
| 737,073 | A * | 8/1903 | Bush | D03D 29/00 28/151 |
| 954,686 | A | 4/1910 | McIntosh | |
| 2,150,843 | A * | 3/1939 | Raba | D03D 29/00 139/93 |
| 2,186,692 | A * | 1/1940 | Boyer | D03D 29/00 139/34 |
| 2,198,624 | A * | 4/1940 | Kimson | D03D 29/00 139/33 |
| 2,209,597 | A * | 7/1940 | Clark | D03D 29/00 139/33 |
| 2,232,312 | A * | 2/1941 | Brooks | D03D 29/00 139/33 |

(Continued)

FOREIGN PATENT DOCUMENTS

CN 202559045 U 11/2012

OTHER PUBLICATIONS

Wecool Toys Inc., PCT/US20/67657, "International Search Report and Written Opinion", mailed Mar. 17, 2021.

*Primary Examiner* — Robert H Muromoto, Jr.
(74) *Attorney, Agent, or Firm* — McKee, Voorhees & Sease, PLC

(57) ABSTRACT

A toy loom allows for children to hold warp threads under tension to facilitate the interweaving of the threads. Resulting weaves can be collected and/or used for play. The toy loom also includes metallic beads, a premium metal charm, lots of clips and clasps, and different colored threads. The toy loom helps children learn different techniques to make a variety of textured and colorful bracelets and necklaces.

8 Claims, 16 Drawing Sheets

(56) References Cited

U.S. PATENT DOCUMENTS 2,241,199 A * 5/1941 Hines ..... D03D 29/00 139/33
2,312,388 A * 3/1943 Clements ..... D03D 29/00 28/151
2,452,011 A * 10/1948 Zippei ..... D03D 29/00 28/152
2,547,250 A * 4/1951 Bennett ..... D03D 29/00 28/151
3,137,320 A * 6/1964 Parton ..... D03D 29/00 139/33
3,347,281 A * 10/1967 Stars ..... D03D 29/00 139/18
3,665,971 A * 5/1972 Ileks ..... D03D 29/00 139/33
3,743,351 A * 7/1973 Harris ..... A47C 13/00 297/118
4,046,172 A * 9/1977 Russell ..... D03D 29/00 139/33
4,081,885 A * 4/1978 Shank ..... D04D 7/04 28/149
4,162,562 A * 7/1979 Beauregard ..... D03D 29/00 28/151
5,146,659 A * 9/1992 Spriggs, II ..... D03D 29/00 139/34
5,355,820 A * 10/1994 Conrad ..... D04H 3/05 156/179
5,413,150 A * 5/1995 Townsend ..... D03D 29/00 139/34
5,603,207 A 2/1997 Hartman
8,234,851 B2 * 8/2012 Wright ..... A44C 27/001 57/10
8,316,894 B2 * 11/2012 Schaub ..... D04B 3/00 139/34
9,038,673 B2 5/2015 Roy et al.
9,121,117 B2 * 9/2015 Teramoto ..... D03D 29/00
9,816,212 B2 * 11/2017 Morris ..... D02G 3/38
9,918,528 B2 * 3/2018 Taylor ..... A44C 17/02
2012/0174405 A1 7/2012 Wright
2014/0147614 A1 * 5/2014 Taylor ..... A44C 17/02 428/67
2016/0009521 A1 1/2016 Morris et al.
2017/0029987 A1 2/2017 Yeung
2020/0367615 A1 * 11/2020 Ng ..... A44C 5/08
2020/0367616 A1 * 11/2020 Ng ..... A44C 27/00
2021/0252905 A1 * 8/2021 Wright ..... B44C 5/00

* cited by examiner

TOY LOOM

CROSS REFERENCE TO RELATED APPLICATIONS

This application is a by-pass continuation of PCT/US2020/067657, filed Dec. 31, 2020, which claims priority to U.S. provisional application Ser. No. 63/009,724, filed Apr. 14, 2020, and 62/956,937, filed Jan. 3, 2020, the entire contents of which are hereby expressly incorporated by reference in their entireties including, without limitation, the specifications, claims, and abstracts, as well as any figures, tables, or drawings thereof.

FIELD OF THE INVENTION

The present invention relates generally to an apparatus and corresponding method of use in at least the toy, arts, and/or crafts industries. More particularly, but not exclusively, the present invention relates to a toy loom for making crafts, such as fabrics resulting from weaving yarn and/or thread.

BACKGROUND OF THE INVENTION

The background description provided herein gives context for the present disclosure. Work of the presently named inventors, as well as aspects of the description that may not otherwise qualify as prior art at the time of filing, are neither expressly nor impliedly admitted as prior art.

Children love toys. For children, toys are more than just fun and games. Most toys provide at least some opportunity for children to learn. The best toys engage the senses, spark imaginations and encourage children to interact with others.

From a very early age, children are eager to learn more about the world around them. Every new shape, color, texture, taste, and sound presents an opportunity to learn more. Parents quickly identify giving their children toys that are safe and stimulating will help their children discover their senses. Rattles and toys that make music are favorites of infants. Toys with contrasting colors are fascinating to babies and stimulate their developing vision. As they grow, infants can use toys to explore object permanence and cause and effect relationships. They also need objects such as blocks to help them build motor skills and hand-eye coordination.

Toddlers can play with a wider variety of toys than infants. Toddlers may still enjoy some of the toys they played with as babies, however they also need that are designed with their increased capability to learn in mind. Even the same blocks they played with previously can provide them with new and different educational opportunities as their knowledge expands. Shape sorters are great for toddlers. They teach them how to match similar items and provide parents the opportunity to teach them the names of the shapes. Lego® blocks, for example, provide an opportunity to learn more about colors and symmetry developing a child's motor skills.

When children reach schooling age, parents and teachers shift their focus from helping children discover their senses to developing a child's aptitude for lingual (e.g., written and spoken), numeric, memorial, and social skills. There are a lot of toys that encourage this type of learning, from simple alphabet puzzles to high-tech electronic gadgets. These toys help give children a head start by introducing them to the things they will be learning in school. Kids who are in school can supplement their learning with recreational and educational toys. Giving children the opportunity to have fun while practicing the things they are learning in school will increase their retention of those things.

The act of collecting toys offers an opportunity for a child to make an emotional connection with their toys. Not surprisingly, the value a child assigns to any given collection is not monetary but sentimental. The collections allow children to relive previous experiences and connect themselves to a period or to a time they feel strongly about. This in effect helps ease insecurity and anxiety and allows the past to continue to exist in the present. Some children collect for the thrill of the hunt. For these children, collecting is a quest, and may develop into a lifelong pursuit which can never be completed. When children collect, they experiment with arranging, organizing, and presenting a part of the world which may serve to provide a safety zone, a place of refuge where fears are calmed, and insecurity is managed. Motives are not mutually exclusive, rather, different motives combine for each collector for a multitude of reasons.

It is often a challenge for toy developers to design a collection which can be used for a purpose other than simply collecting the item itself, such as stimulating the child's senses while the child is playing with the toy collection or challenging the child's aptitude for continued learning. For example, water balloons and water bombs are toys which can stimulate a child's senses and engage the child's aptitude for continued learning while the child is playing with the toy, however the child is left with nothing to collect after a water balloon war but latex rubber that must be discarded in the trash. In another example, trading cards are collectable toys which are limited in their ability to stimulate a child's senses during play. In yet another example, dolls are collectable toys which are limited in their ability to challenge the child's aptitude for continued learning.

Thus, there exists a need in the art for toy(s) which address these issues and do not rely on the use of expensive, high-tech electronic gadgets.

SUMMARY OF THE INVENTION

The following objects, features, advantages, aspects, and/or embodiments, are not exhaustive and do not limit the overall disclosure. No single embodiment need provide each and every object, feature, or advantage. Any of the objects, features, advantages, aspects, and/or embodiments disclosed herein can be integrated with one another, either in full or in part.

It is a primary object, feature, and/or advantage of the present invention to improve on or overcome the deficiencies in the art.

The toy loom disclosed herein can be used in a wide variety of applications. For example, children can salvage collectable items (e.g., fabrics), play with individual components of the toy (e.g., loom components), or form new toys (e.g., accessories for dolls) through the assembly of different components of the toy.

It is a further object, feature, and/or advantage of the present invention to allow children to weave a near-infinite number of potential necklaces, bracelets, and other apparel-accessories. For example, the toy loom should include enough hooks to allow children to create distinct braids and waves through the use or intentional non-use of specific hooks during the weaving process. In other example, switching inputs of raw materials, such as the type and/or color of threads will increase the near-infinite number of potential necklaces, bracelets, and other apparel-accessories which can be created.

It is still yet a further object, feature, or advantage of the present invention to provide a child the ability to play with the toy while playing with other children. For example, a means for engaging social media may be provided with the toy.

It is preferred the toy loom be safe (e.g., non-toxic), cost effective, and durable.

At least one embodiment disclosed herein comprises a distinct aesthetic appearance. Ornamental aspects included in such an embodiment can help capture a consumer's attention and/or identify a source of origin of a product being sold. Said ornamental aspects will not impede functionality of the present invention. For example, the toy loom can be themed such that the hooks, slidable members, and input and/or release mechanisms all have a first color and the base, handles, ends, and disks all have a second, complementary color.

Methods can be practiced which facilitate use, manufacture, assembly, maintenance, and repair of a toy loom which accomplish some or all of the previously stated objectives.

The toy loom can be incorporated into systems or kits which accomplish some or all of the previously stated objectives.

The toy loom described herein can be constructed entirely of mechanical components and used in absence of a power source, such as dry cell batteries.

These and/or other objects, features, advantages, aspects, and/or embodiments will become apparent to those skilled in the art after reviewing the following brief and detailed descriptions of the drawings. Furthermore, the present disclosure encompasses aspects and/or embodiments not expressly disclosed but which can be understood from a reading of the present disclosure, including at least: (a) combinations of disclosed aspects and/or embodiments and/or (b) reasonable modifications not shown or described.

BRIEF DESCRIPTION OF THE DRAWINGS

Several embodiments in which the present invention can be practiced are illustrated and described in detail, wherein like reference characters represent like components throughout the several views. The drawings are presented for exemplary purposes and may not be to scale unless otherwise indicated.

An artisan of ordinary skill need not view, within isolated figure(s), the near infinite number of distinct permutations of features described in the following detailed description to facilitate an understanding of the present invention.

DETAILED DESCRIPTION OF THE INVENTION

The present disclosure is not to be limited to that described herein. Mechanical, electrical, chemical, procedural, and/or other changes can be made without departing from the spirit and scope of the present invention. No features shown or described are essential to permit basic operation of the present invention unless otherwise indicated.

Figure 1:
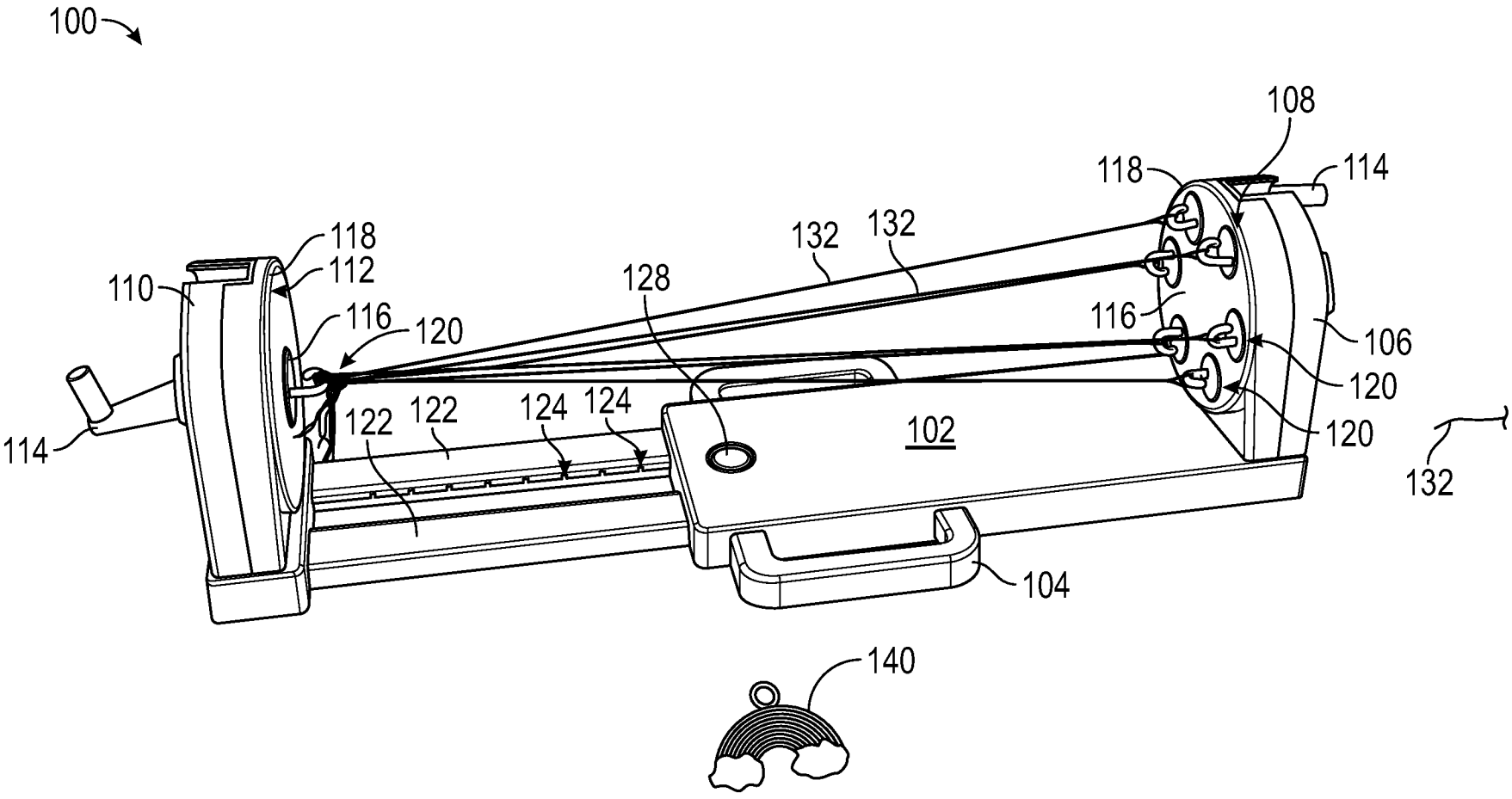
FIG. 1 shows a rear perspective view of a modular toy loom.
Figure 2:
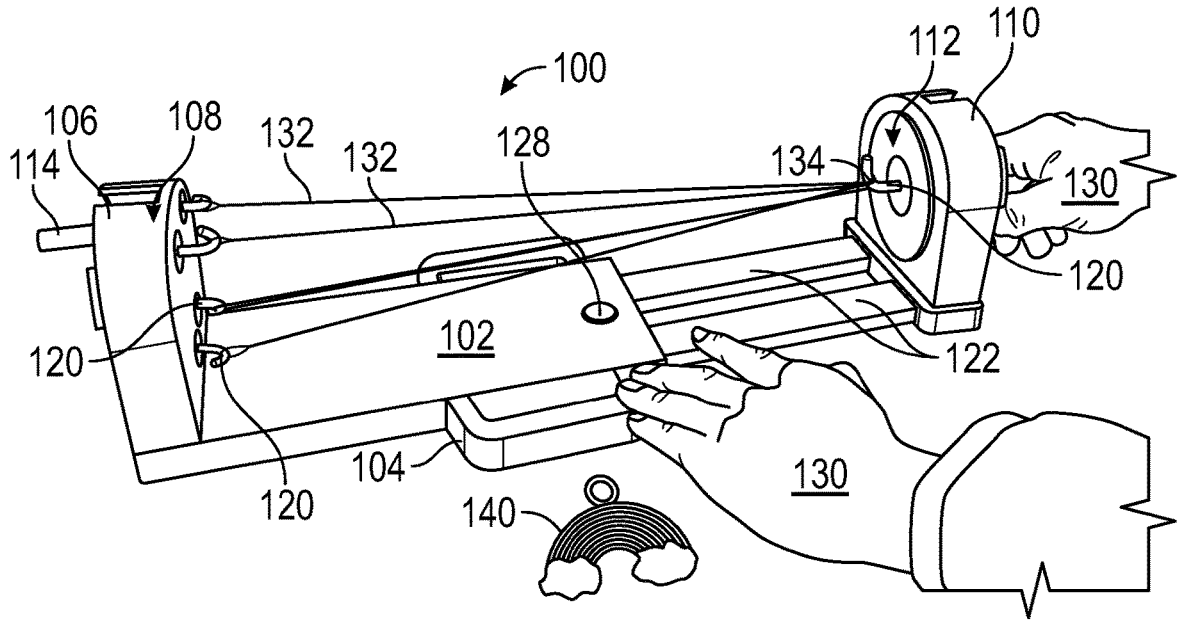
FIG. 2 shows a front perspective view of the modular toy loom of FIG. 1.
Figure 3:
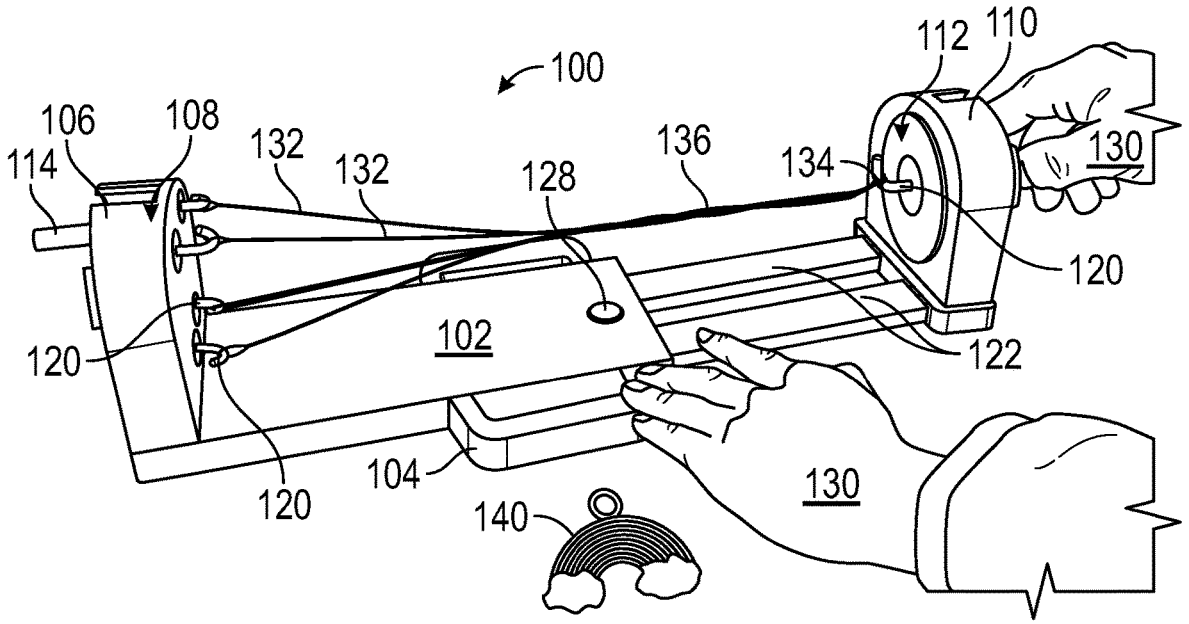
FIG. 3 shows a braid beginning to form as a result of rotating a disk with a string secured thereto.
Figure 4:
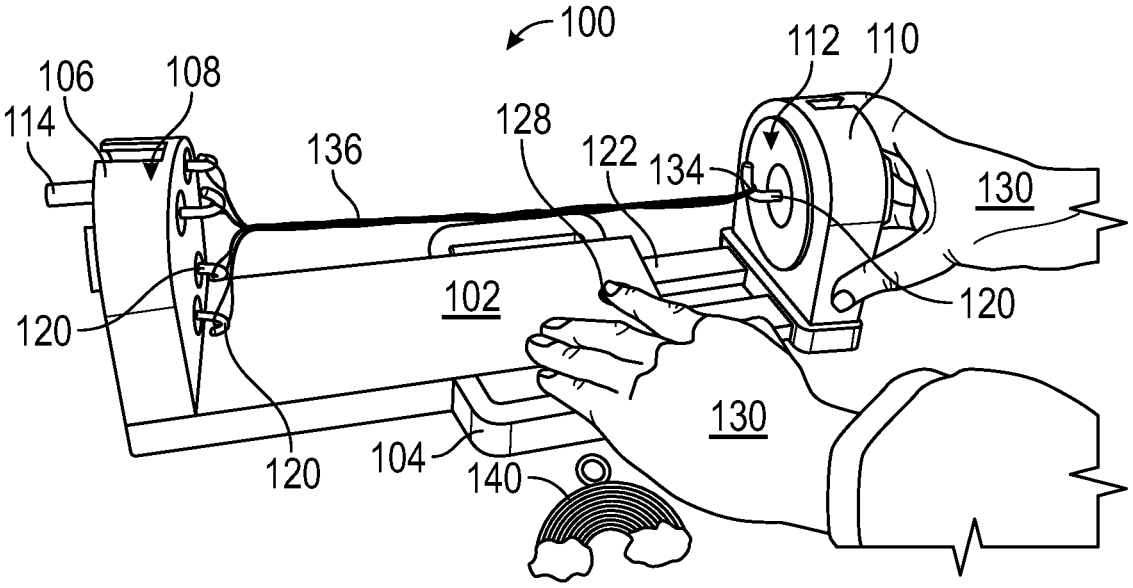
FIG. 4 shows a user retracting the base by depressing a button which releases mechanisms from engaging notches of slidable members and pushing the expandable end of the toy loom inward, thereby tightening the formed braid.
Figure 5:
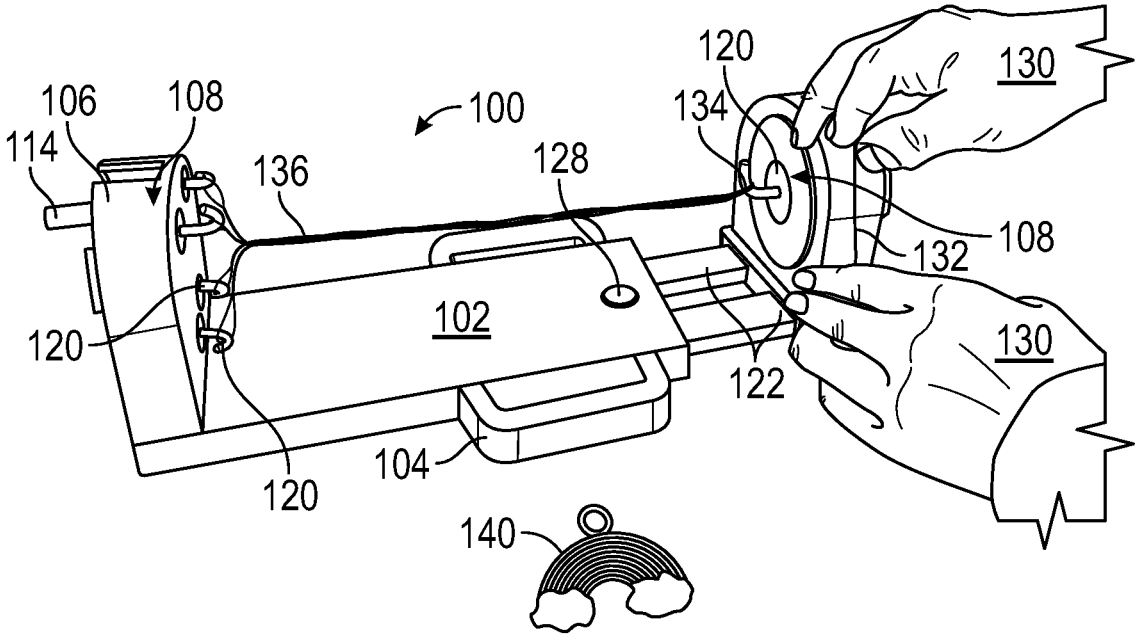
FIG. 5 shows a formed braid not yet removed from the toy loom and a separate string procured by the user.
Figure 6:
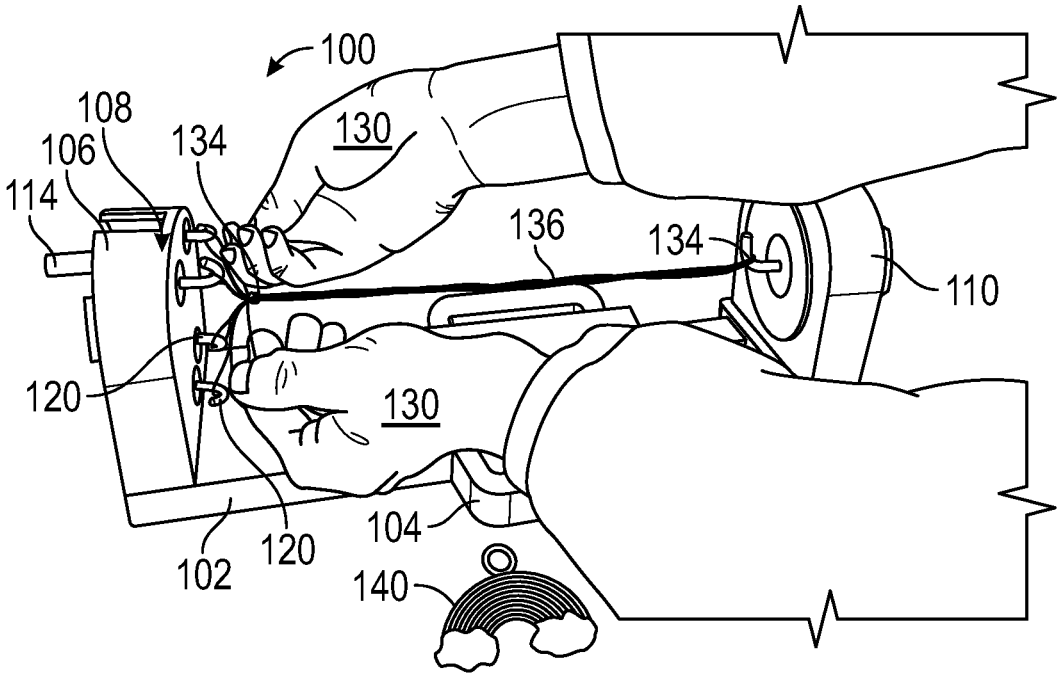
FIG. 6 shows, using the string, a knot being tied to the formed braid near a fixed end of the base.
Figure 7:
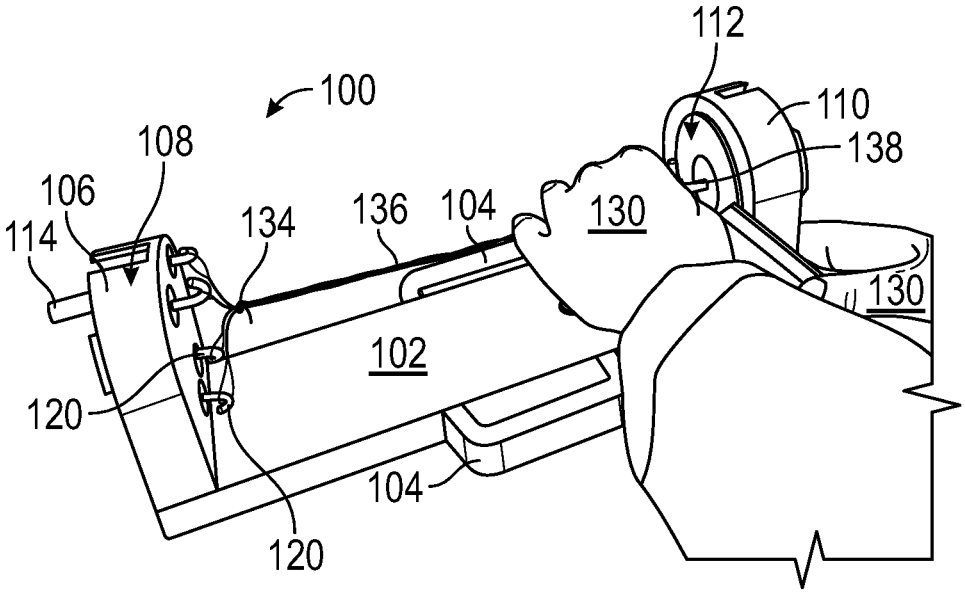
FIG. 7 shows a user removing, by cutting, the formed braid from the toy loom near a rotatable end of the base.
Figure 8:
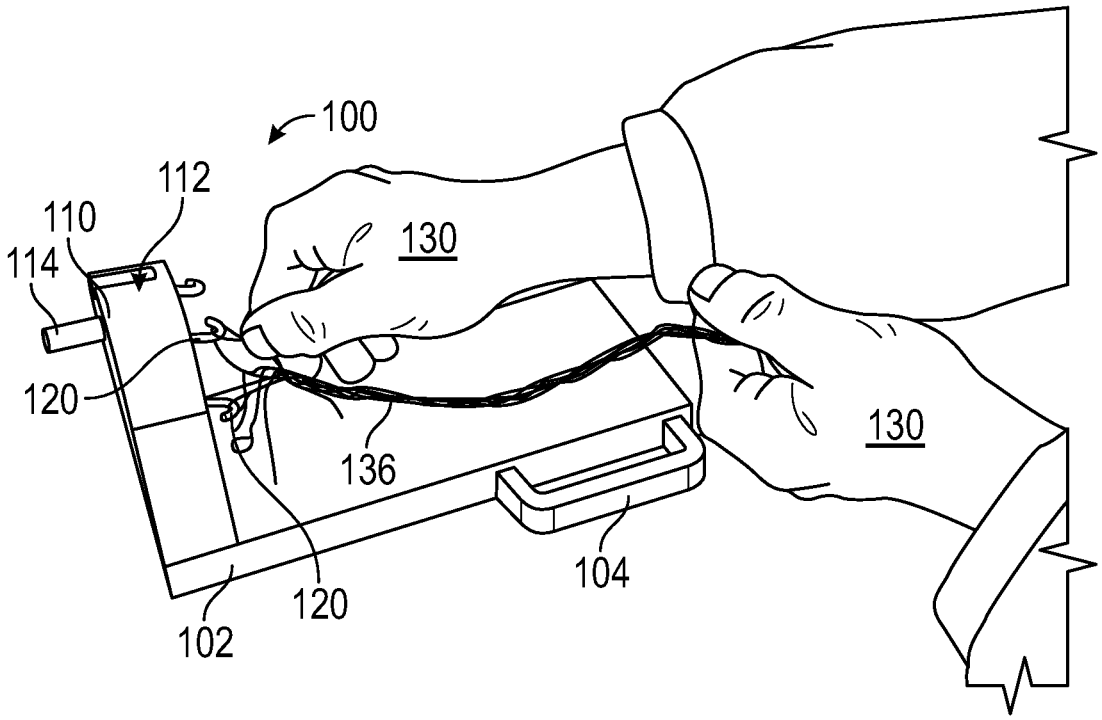
FIG. 8 shows a user unhooking the formed braid from the toy loom near a fixed end of the base.

The toy loom 100 as shown in FIGS. 1-8 is multifunctional. The toy loom 100 is capable of, but not limited to, creating unique braids or weaves 136 (see FIG. 89) which can be used to craft necklaces, anklets, bracelets, and the like. For example, ends of a braid or weave 136 can attach (a) to one another to form a bracelet or (b) to other ends of additional braids or weaves 136 to form a necklace. Such attachments can be made with knots, adhesives such as glue, fasteners such as clasps, and the like. In some embodiments, the toy loom 100 confers the ability to place and anchor charms, jewels and other accessories into the woven creation.

The toy loom includes a retractable, expandable base 102. Retraction and expansion of the base 102 will allow for (a) the creation of multiple lengths of end products, such as various fabrics and/or ropes, and (b) tightening of the braid or weave 136. The precise shape of the toy loom 100 and its mechanics may vary, but basic function(s) will remain the same.

In a preferred embodiment, the toy loom 100 will include transport members 104, such as handles for carrying, which are attached to the base 102. The toy loom 100 can thus fold up into a little compact size so kids can easily take it on the go. The base 102 can also include a fixed end 106, which does not move when the base 102 is expanded and/or retracted. The fixed end 106 can be one integral piece, or alternatively, can include a removable fixed disk 108 so that the fixed disk 108 can be disassembled and subsequently reassembled for storage and further play, respectively. At an end opposite the fixed end 106, the base 102 can include a rotatable end 110, which moves when the base 102 is expanded and/or retracted. The movable end 110 can also rotate as a whole, if made from one integral piece, or alternatively, can comprise a rotatable disk 112 therein, which may or may not be removable from the toy loom 100. The rotatable disk 112 can be rotated via input member 114, which can for example be a rotatable handle. Other input members 114 included with the device may be used to facilitate disassembly and assembly of the disks 108, 112 from the toy loom 100. The ends 106, 110 and/or disks 108, 112 typically each comprise a center 116 and a perimeter 118.

Hooks 120 attach to both ends 106, 110. For example, in a preferred embodiment, the fixed end 106 will comprise circumferentially spaced apart hooks 120 near the perimeter 118. The circumferentially spaced apart hooks 120, for example, can also be symmetrically arrayed about the fixed disk 108. In such an embodiment, the circumferentially spaced apart hooks 120 are thus each spaced a substantially similar radial distance away from the center 116 of the fixed disk 108. In the same preferred embodiment, and at the movable end 110, a single shared hook to which several strings 132 may be secured is centrally located within the rotatable disk 112. While any suitable number of hooks may be chosen, it will be appreciated that where circumferentially arrayed hooks 120 are used, a reasonable amount of space must exist between each of them so as to allow for the width of the human finger and for use of the toy loom 100.

Alternative embodiments having similar functions exist and can thus be directly derived from what is included in the present disclosure. For example, an embodiment where the circumferentially spaced apart hooks 120 are associated with the movable end 110 and the rotatable disk 112 and the centrally located shared hook 120 is associated with the fixed end 106 and fixed disk 108. Further, it is possible the fixed end 106 is associated with the rotatable disk 112 and the movable end 108 associated with the fixed disk 108. Further, some embodiments will exist where (i) both sides have several hooks 120, (ii) both sides have a rotatable disk 112, (iii) both sides have one hook 120, (iv) the hooks of one or more of the sides are asymmetrically arranged, and/or (v) one end is formed from one integral piece while the other end utilizes a removable disk 108/112.

Expansion and retraction of the base 102 can be accomplished through the use of slidable connections 122. More particularly, but not exclusively, guided members movable through internal tracks of the base 102 can be used to increase and/or decrease length of the base 102 in an outward/inward direction, respectively. The guided members, for example, can be configured such that the toy loom 100 can only be locked in at pre-set lengths, determined by notches 124 in the guided members. Markings on the base 102 and/or guided members can include information corresponding to the pre-set lengths, similar to a ruler. The marking can thus include characters or numbers representing particular positions of the toy loom 100, a length of a weave formed at a particular pre-set length of the device, and the like. Any notches 124 and/or markings are preferably spaced at uniform increments, however exponential and/or other non-uniform scales can be used.

Engagement mechanism(s) 126, such as spring-loaded pins or other resilient members (e.g. elastomers, ratchet-pawl combinations, actuators, etc.) can engage the notches 124 and thereby maintain the toy loom 100 at pre-set lengths. To then allow for further expansion and/or retraction of the toy loom 100, release mechanism(s) 128, such as buttons, latches, levers, locks, and the like, can be used to disable or otherwise temporarily prevent the engagement mechanism(s) 126 from engaging.

The item(s) to be woven by the toy loom are not limited to threads. Such items can also include strings, threads, and/or yarn 132, satin para chords, knotting cords, wax cotton cords, and the like. Various numbers of item(s) to be woven may be used by one toy loom 100, wherein the number and placement (e.g. on a particular hook 120 attached to the a retractable, expandable base 102) of said item(s) can result in unique resulting braids 136, plaits, and/or complex structures or patterns formed by interlacing three or more strands of flexible material such as textile yarns, wire, or hair.

During operation, an easy handle turning mechanism 114 allows a user to spin/weave the strings, threads, and/or yarn 132 until the user is satisfied with the look of the braid or weave 136. More particularly, spinning/weaving is done by intersecting the longitudinal strings, threads, and/or yarn 132, the warp, i.e. "that which is thrown across," with the transverse strings, threads, and/or yarn 132, the weft, i.e. "that which is woven." After a braid or weave 136 has been created, the user, via the user's hands 130, can then tie or knot 134 the ends of or otherwise alter the braid or weave 136 such that the weave is able to retain form without tension from the toy loom. The braid or weave 136 can then be removed from the toy loom by cutting (e.g. using blade 138), unhooking, or otherwise separating ends of the braid or weave 136 from the retractable, expandable base 102.

The toy loom 100 is well-suited for play, and thus can be sized appropriately. To enhance play, the toy loom 100 can incorporate weave charms and other toy accessories 140 into the weaving process and/or end products (bracelets/necklaces) formed from braids created as a result of the toy loom 100.

Figure 9:
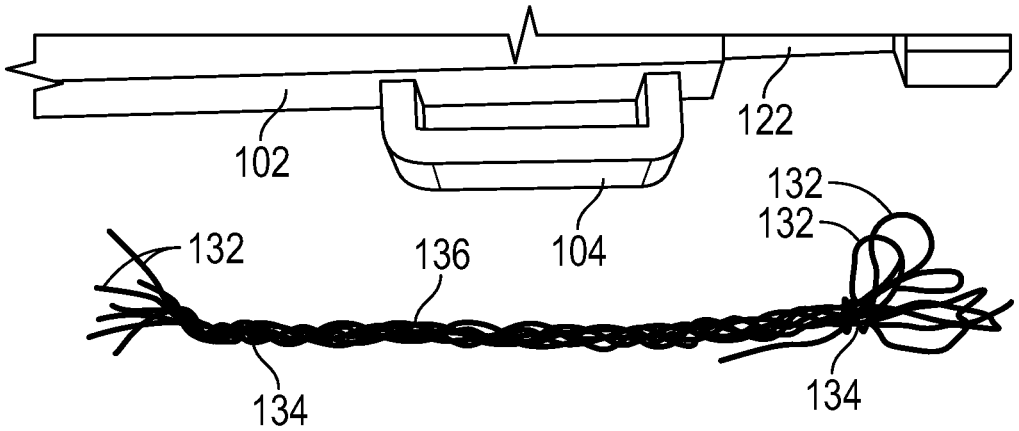
FIG. 9 shows a top elevational view of a weave, fabric, and/or rope incorporating the formed braid, the weave, fabric, and/or rope created using the modular toy loom of FIGS. 1-2.
Figure 10:
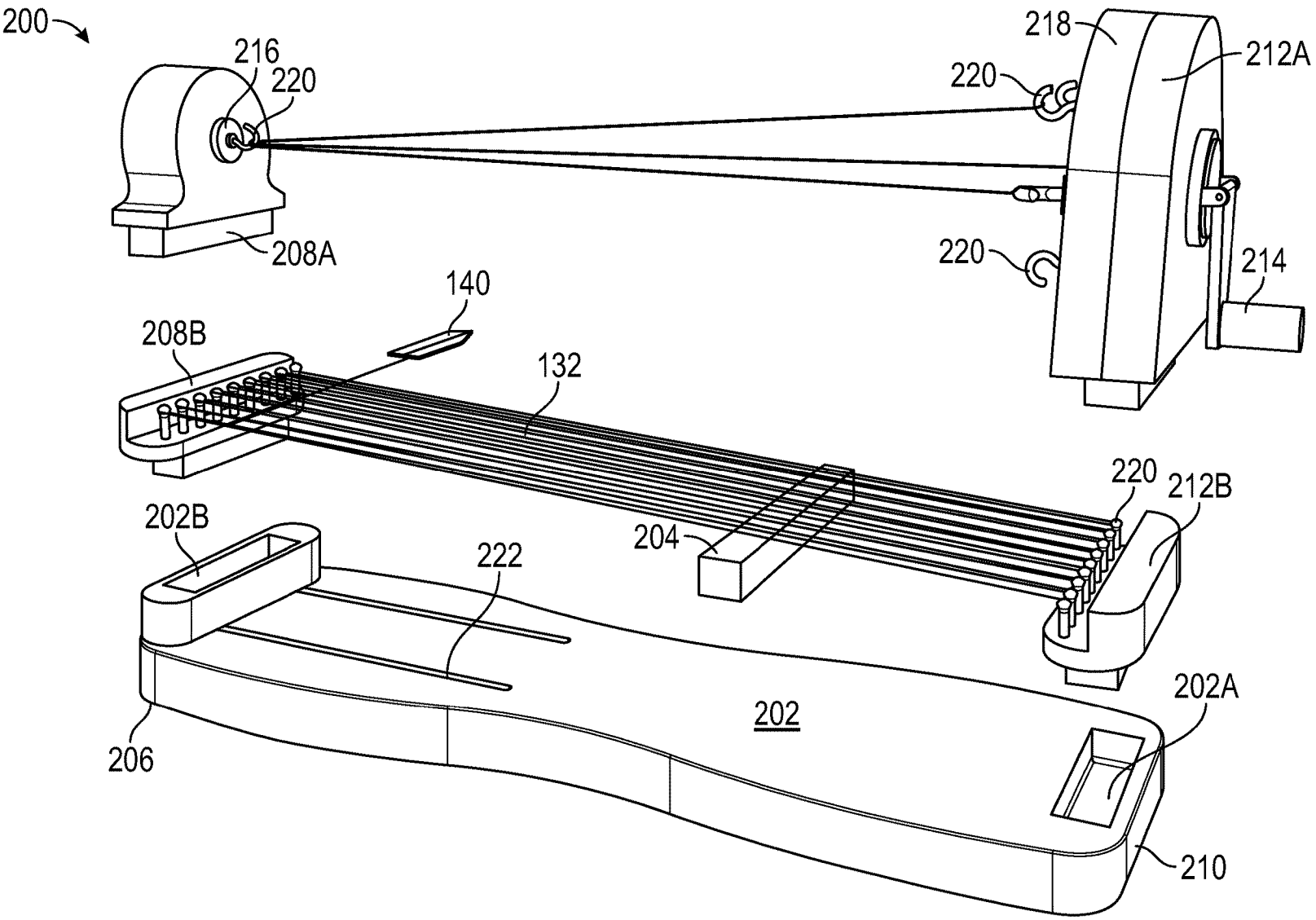
FIG. 10 shows a kit view of an alternative modular toy loom.
Figure 11:
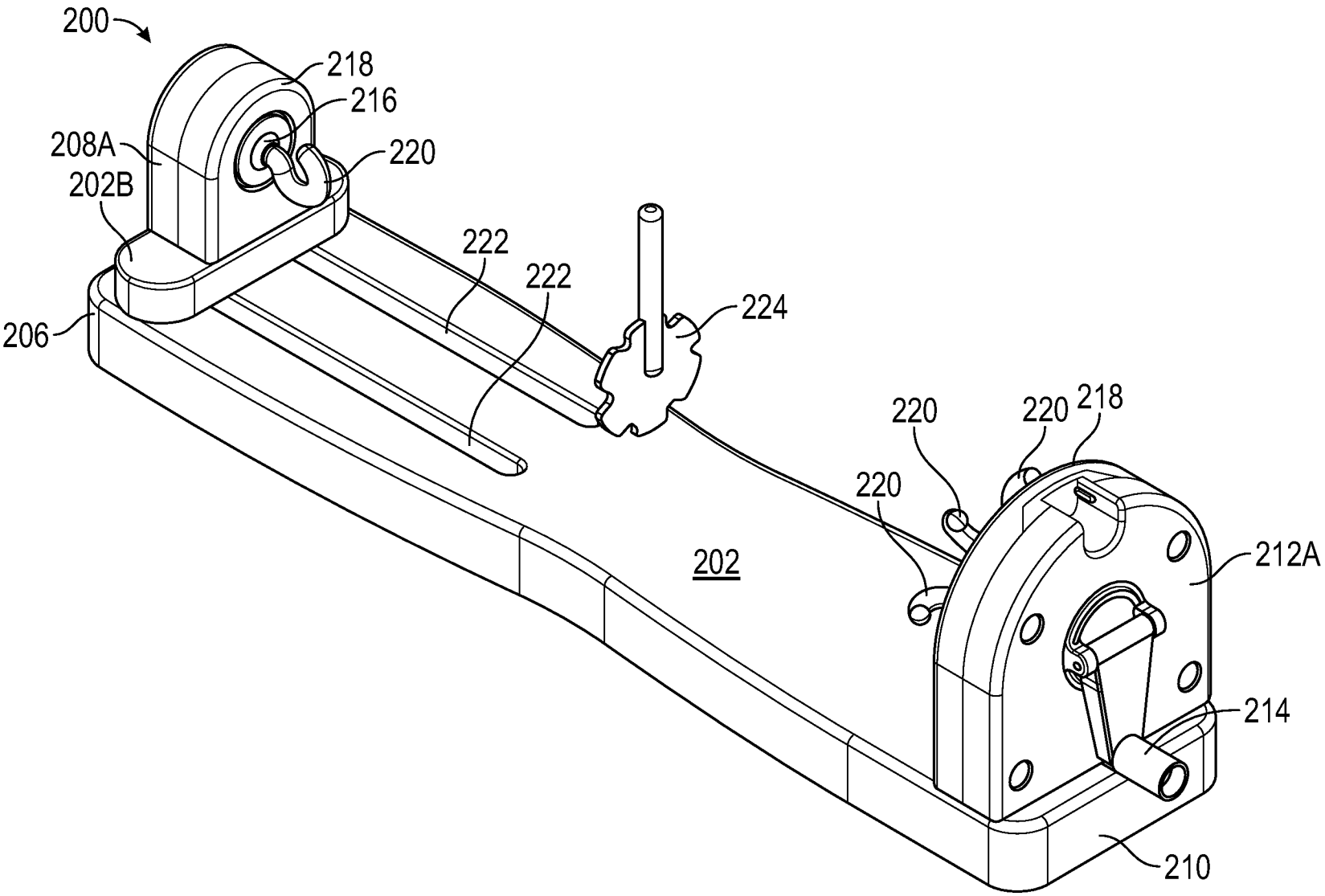
FIG. 11 shows a perspective view of the alternative modular toy loom with first and second removable inserts assembled thereon.
Figure 12:
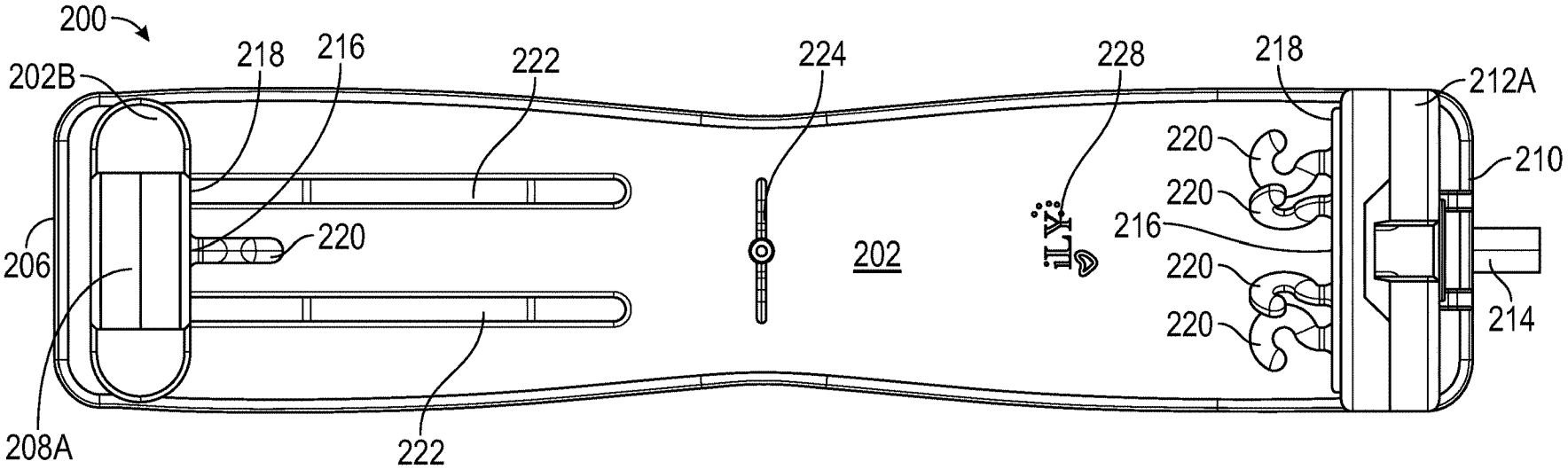
FIG. 12 shows a top view of the alternative modular toy loom with first and second removable inserts assembled thereon.
Figure 13:
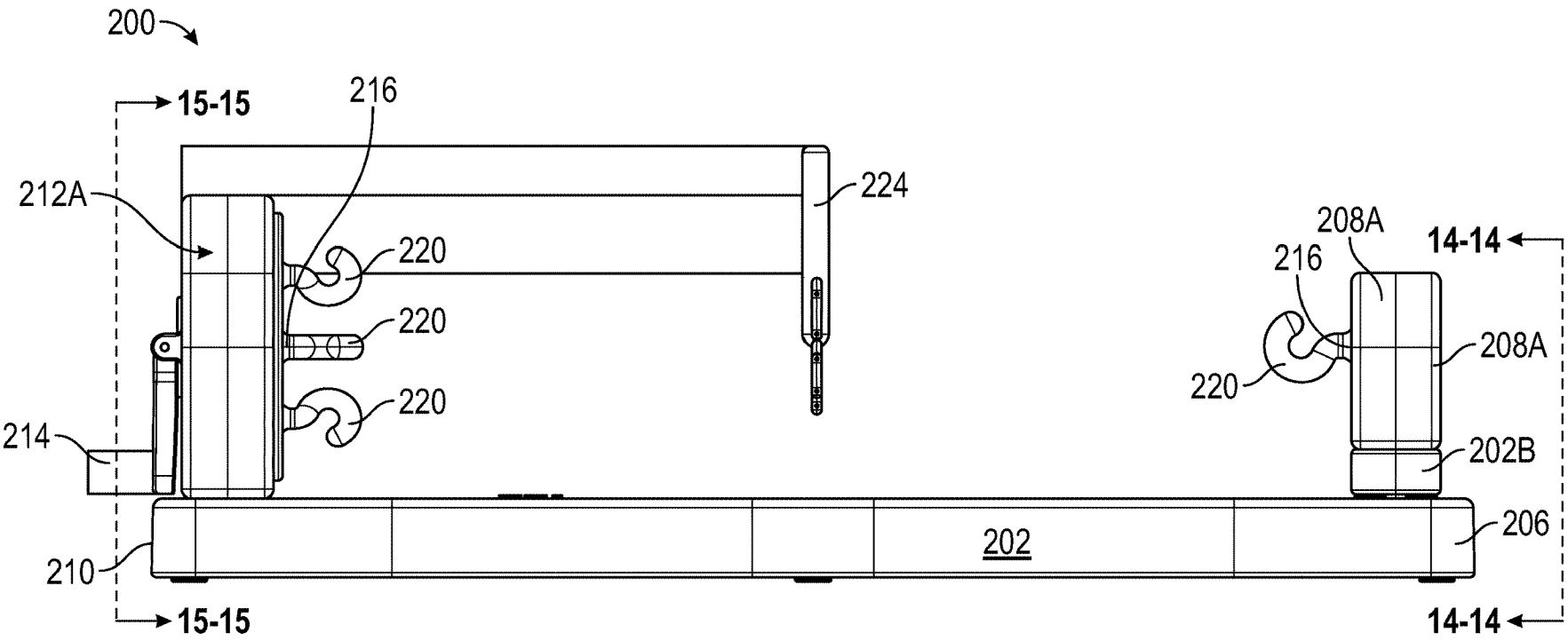
FIG. 13 shows an edge view of the alternative modular toy loom with first and second removable inserts assembled thereon.
Figure 14:
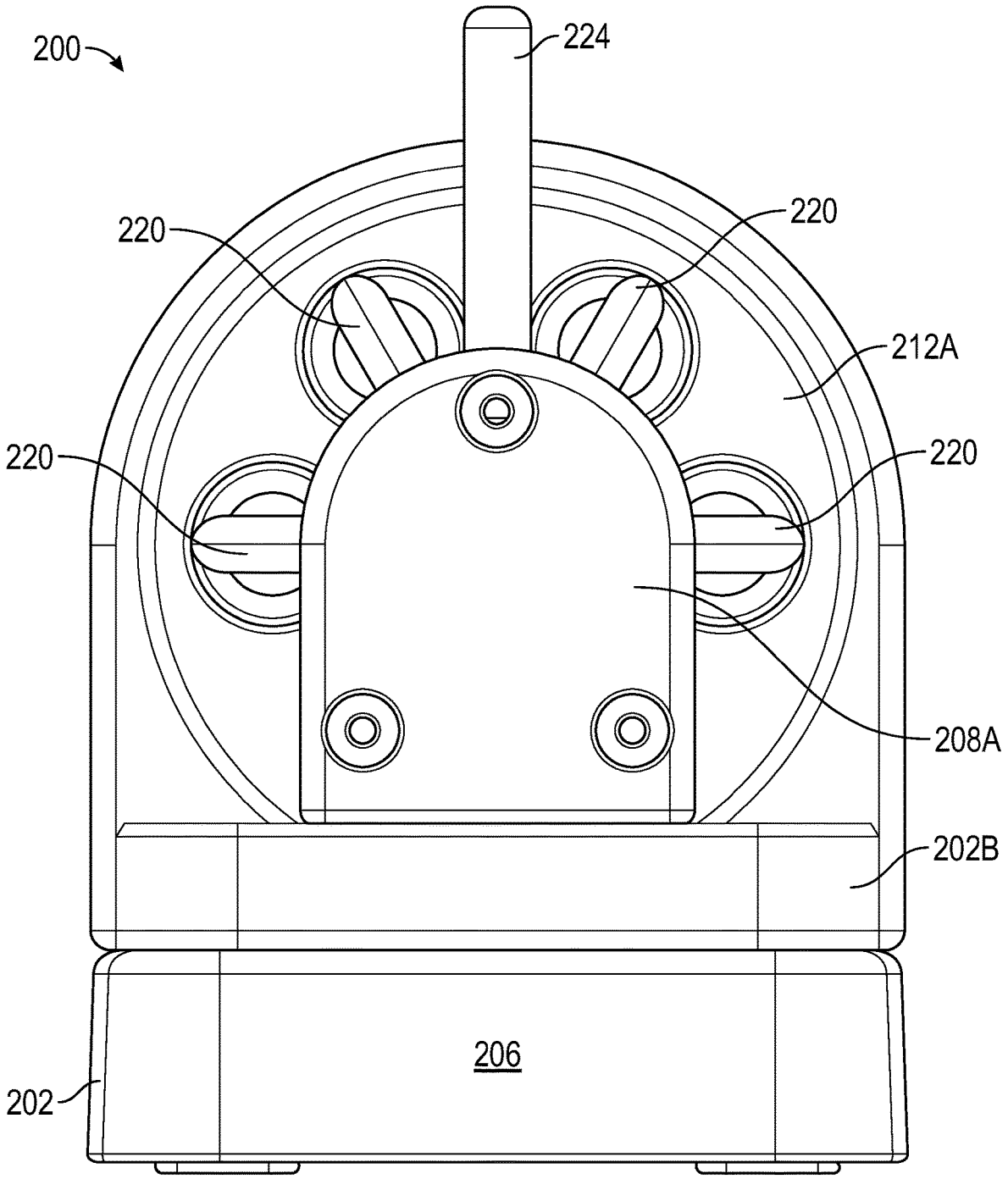
FIG. 14 shows a first end view of the alternative modular toy loom with first and second removable inserts assembled thereon.
Figure 15:
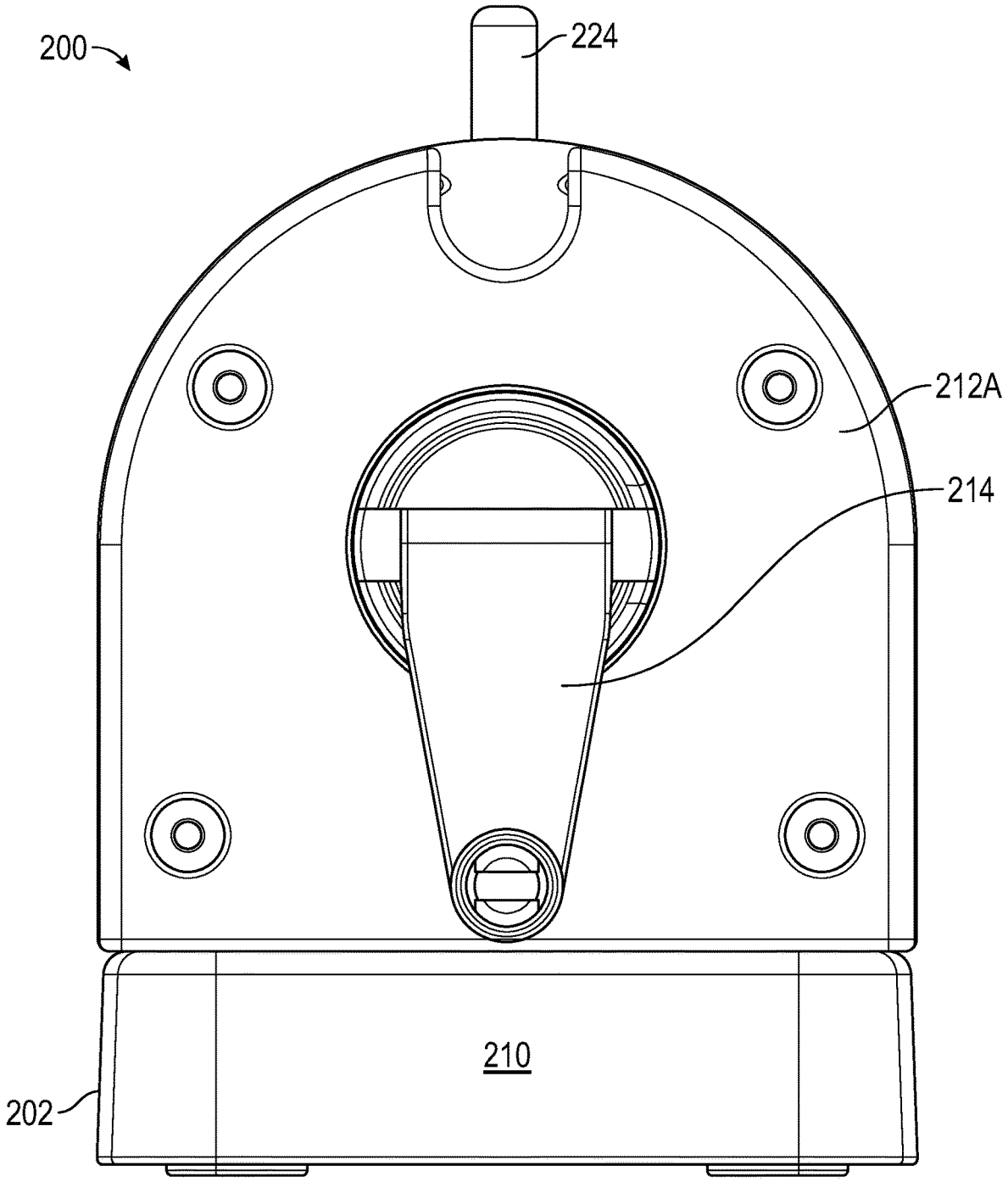
FIG. 15 shows a second end view of the alternative modular toy loom with first and second removable inserts assembled thereon.
Figure 16:
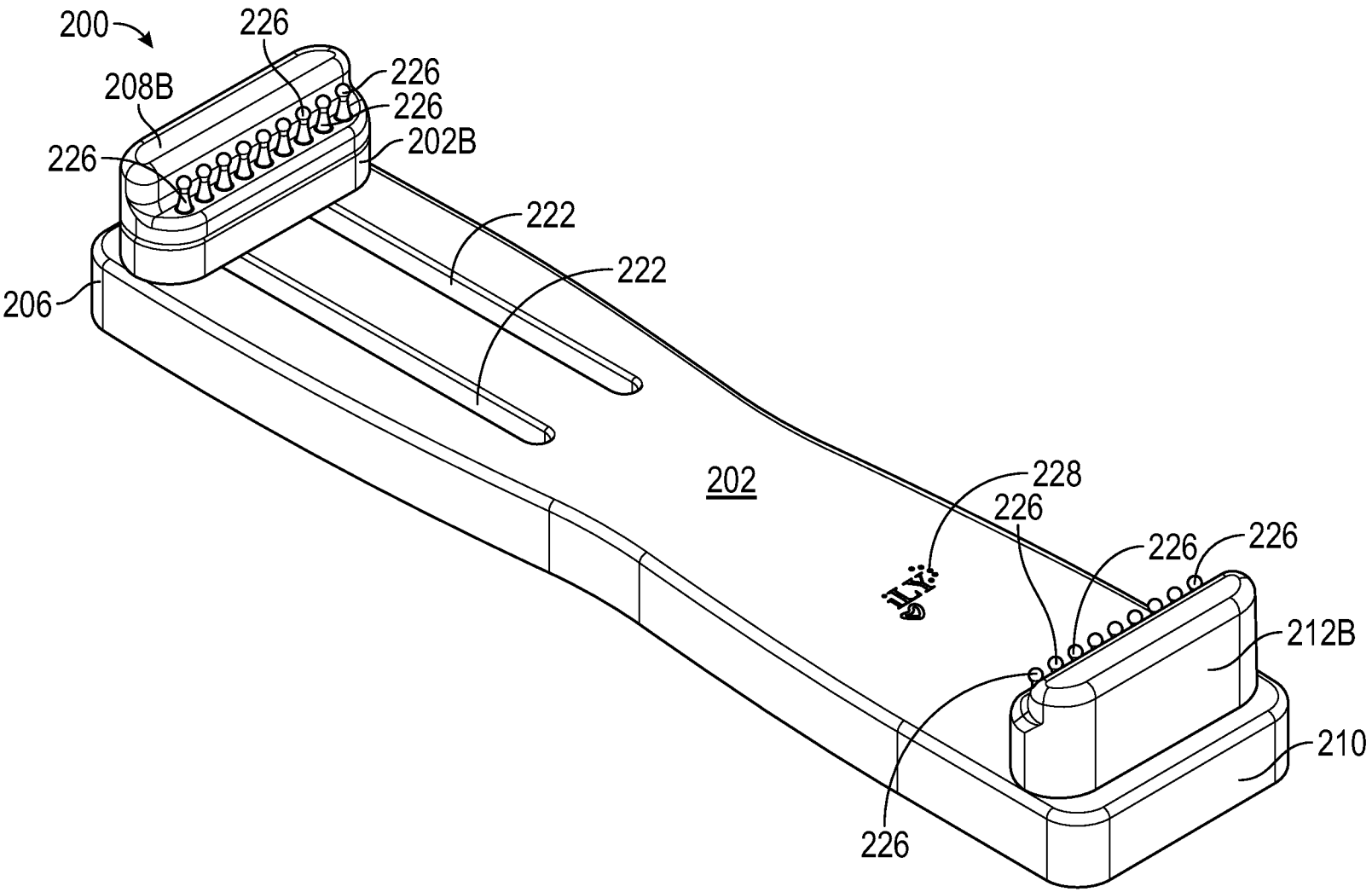
FIG. 16 shows a perspective view of the alternative modular toy loom with third and fourth removable inserts assembled thereon.
Figure 17:
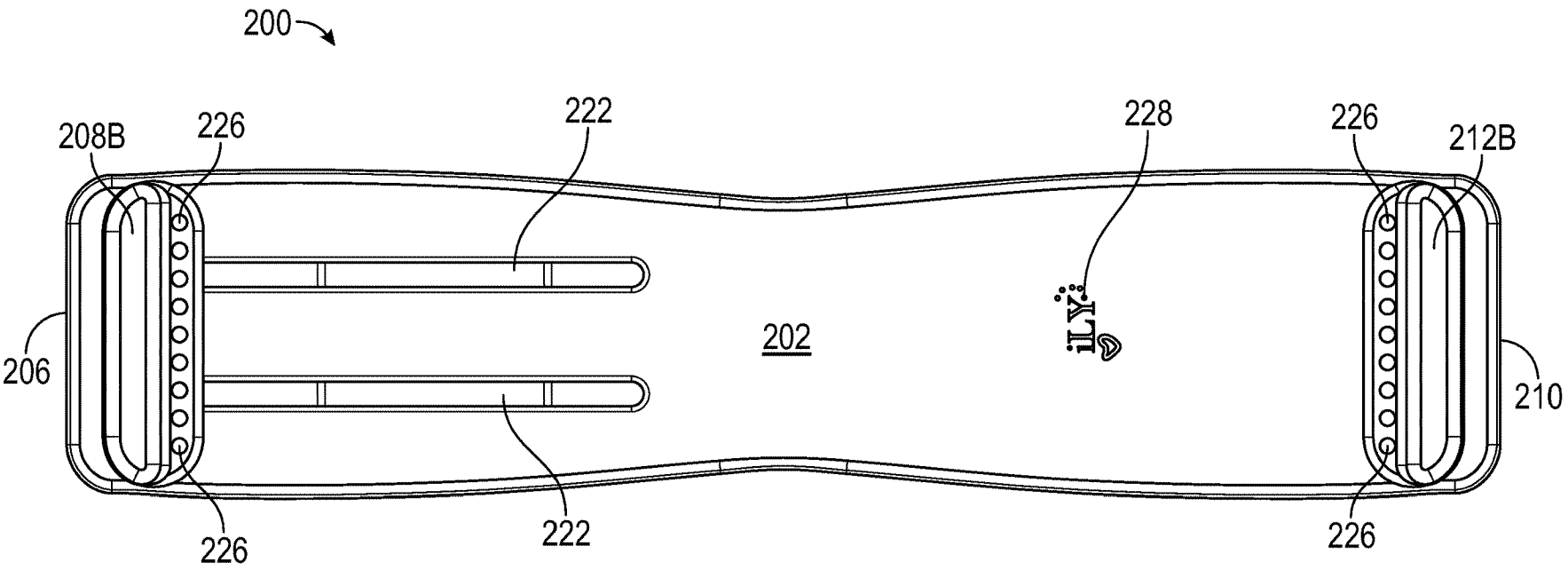
FIG. 17 shows an edge view of the alternative modular toy loom with third and fourth removable inserts assembled thereon.
Figure 18:
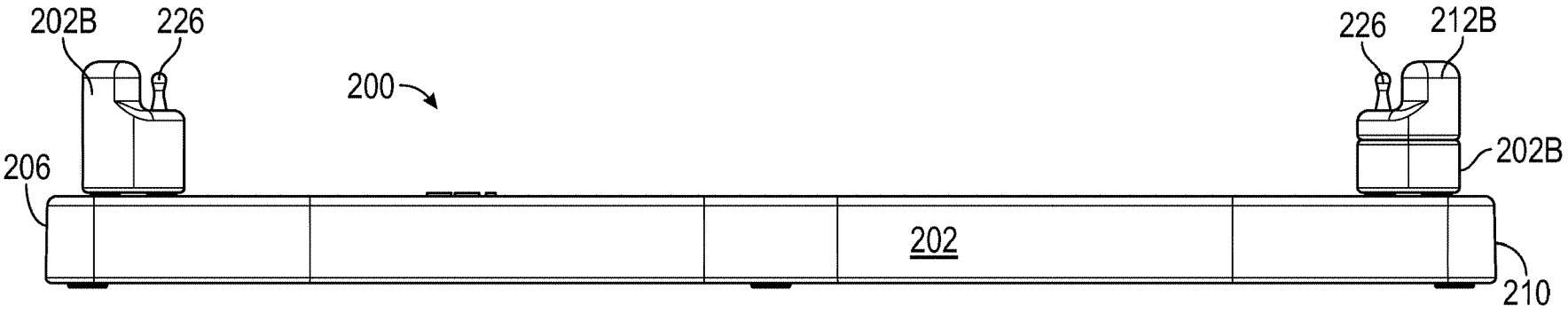
FIG. 18 shows an end view of the alternative modular toy loom with third and fourth removable inserts assembled thereon.
Figure 19:
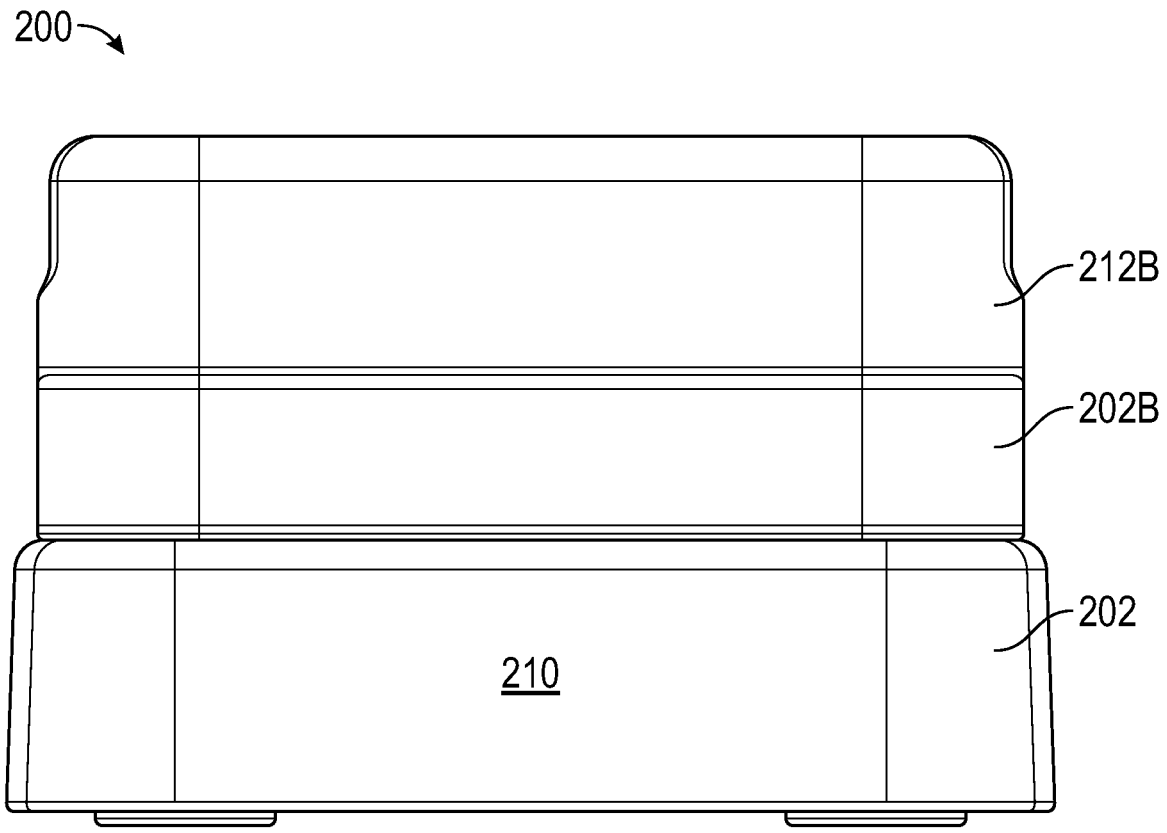
FIG. 19 shows an edge view of the alternative modular toy loom with third and fourth removable inserts assembled thereon.
Figure 20:
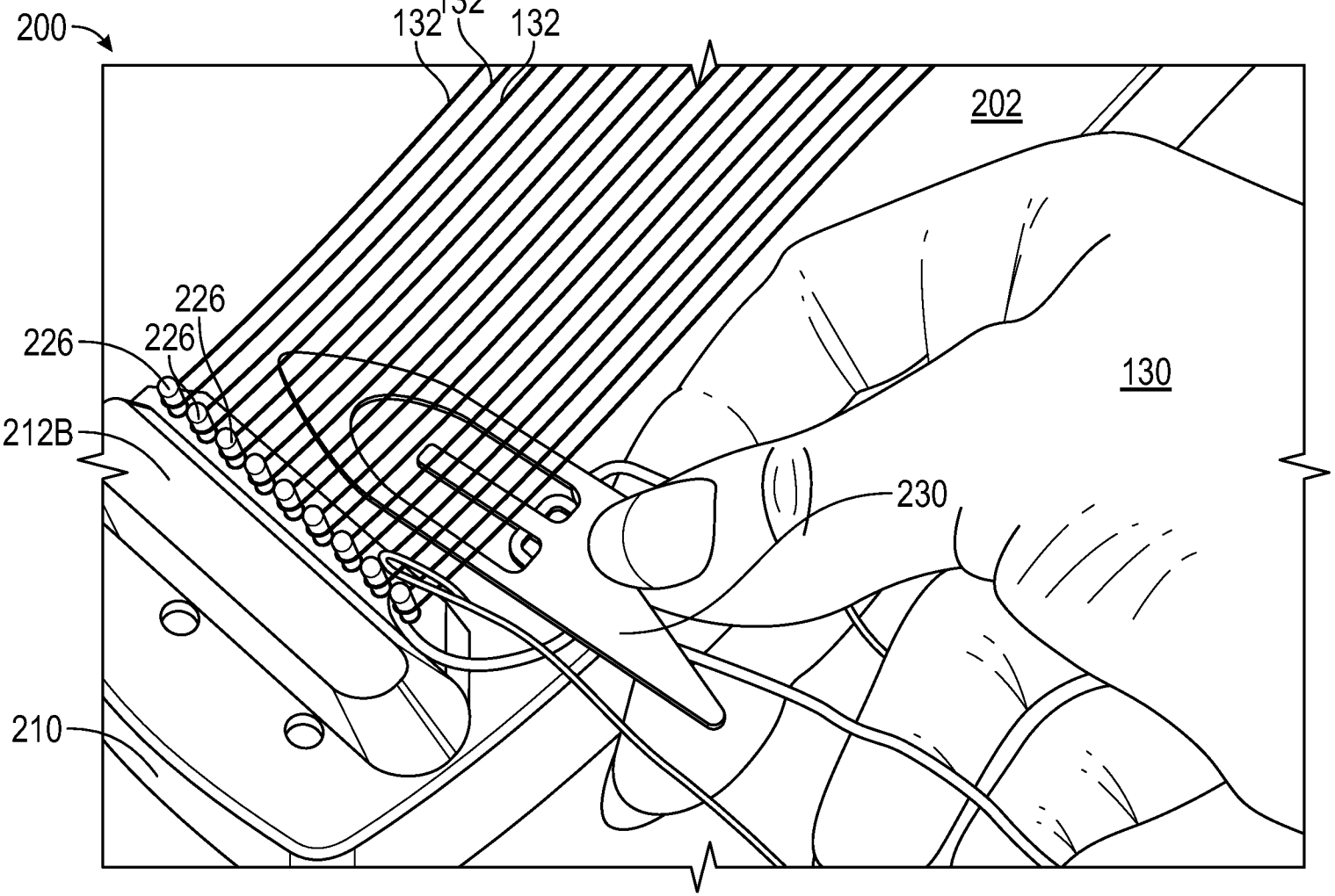
FIG. 20 shows a detailed view of an alternative clip/clasp usable with the alternative toy loom of FIGS. 10-19.

However, it is to be appreciated the embodiment shown in FIGS. 1-9 is not the only embodiment of a toy loom capable of addressing the stated objectives of the present invention. For example, the embodiment shown in FIGS. 10-19 offers similar advantages, if not more. In particular, the toy loom 200 is similarly modular, and can utilize similar slidable connection(s) 222 to adjust a dimensional aspect of said modular toy loom 200.

The toy loom 200 is similar to the previously shown toy loom 100 in that the toy loom 200 comprises a base 202, the base 202 preferably being foldable, ends 206, 210, an input member 214 such as a rotatable handle, and other like components. Additionally, the alternative toy loom 200 can be used to employ similar notches, engagement mechanism(s) 126, release mechanism(s) 128, etc. to facilitate the creation of similar braids 136, which can include similar charms and/or accessories 140.

The particular embodiment shown in FIGS. 10-19 does not have to establish a slidable connection between separate base members. Instead, the modular toy loom 200 provides a non-exhaustive number of removable inserts 208A-N, 212A-N which can be inserted into cavit(ies)/receptacle(s) 202A, 202B adjacent ends 206, 210. As shown in the figures, the cavity and receptacle 202A, 202B both comprise female connectors which can receive corresponding male connectors of the removable inserts 208A-N. It is to be appreciated embodiments exist where the inserts 208A-N, 212A-N include female connectors which can receive corresponding male connectors protruding from the base 202 and/or a receptacle/other separate component extending upward from the base 202. As shown, the cavity 202A recesses into an upper surface of the base 202 adjacent the second end 210. The receptacle 202B protrudes from the upper surface of the base 202 adjacent the first end 206. It is to be appreciated embodiments exist where (a) two cavities 202A are utilized at both ends or (b) two receptacles 202B are utilized at both ends. It is however preferred that one receptacle 202B and one cavity 202A be used because it helps facilitate creating an elevational difference across the base 202.

First and second complementary inserts 208A, 212A, for example, can still include annularly spaced apart hooks 220 and a central, shared hook 220 which can be rotated and/or slidably moved in relation to one another to form braids. In some embodiments, rotation of the hooks 120 can be accomplished in both the clockwise and counterclockwise directions, and the particular direction during operation will depend on how the user delivers input to the input member 214.

While it is preferable the slidable connection 222 exists so that only one of the first or second complementary insert 208A, 212A is movable with respect to the base 202, as shown, it is to be appreciated there are embodiments where both inserts 208A, 212A are in slidable connection with the base 202. The slidable connection 222 can be established by guides in the receptacle 202B (shown, preferable) or inserts 208A, 212A (not shown) movable through tracks in the base 202. An advantage of establishing the slidable connection between the receptacle 202B and the base 200 is that the slidable connection 222 does not need to be disengaged during the interchange of distinct inserts 208A-N, 212A-N.

The centers 216 of the first and second complementary inserts 208A, 212A, as shown, are located at the same elevation and along a longitudinal axis located parallelly above the upper surface of the base 202. To achieve this effect, the distance from the bottom of the first complementary insert 208A to its center 216 is less than the distance from the bottom of the second complementary insert 212A to its center 216 by a distance equal to the height of the receptacle 202B.

Also included with the modular toy loom 200 are third and fourth complementary inserts 208B, 212B which include linearly spaced apart pegs 226, such that the modular toy loom 220 can be used similarly to a traditional loom. The support member 204, one or more dividers 224, and/or one or more clips/clasps 230 can be included with the toy loom 200 and used strategically (e.g. by positioning) to allow for the creation of tension and/or compression (slack) to create interesting and distinct weaves and braids. The divider 224 shown in the figures, for example, includes notches through which threads can be positioned so that threads are braided only at desired locations (at a location up/downstream from the divider 224); the clips/clasps 230 can be employed to pinch and bind groups of threads and strings for the same purpose.

As shown, the third and fourth complementary inserts 208B, 212B are mirror images of one another. Thus, in particular configurations where the inserts 208B, 212B are symmetrical across their width and length, an identically manufactured component may be used for both the inserts 208B and 212B, thus establishing interchangeability among the inserts 208B, 212B.

Still further, there will exist embodiments where, despite the inserts not being identical, both inserts 208B, 212B can be still be inserted at both ends 206, 210 of the toy loom 200. In such embodiments, if the spaced apart pegs 226 are located along arcs instead of a line, the inserts 208B, 212B could be inserted into the toy loom 200 to achieve a convex configuration, and if the inserts were taken out and switched at each end, a convex configuration.

Again, while it is preferable the means for establishing the slidable connection 222 exists between the receptacle 202B and the base 202, there will exist embodiments wherein third and/or fourth complementary insert 208B, 212B can include such means and are independently in slidable connection with the base 202.

Thus, it follows that in the preferred kit, there can be at least three, and even more preferably four, distinct removable inserts 208A, 208B, 212A, 212B. Each of the four distinct removable inserts could comprise distinct hook and/or functional configurations.

Most components of the toy looms 100, 200 described herein are made of rigid plastics, such as polyester. Accessories to go with said toy looms 100, 200, such as the charms 140 may be made from metallic alloys. A product identifier 228 can be included on the base 202 of the toy loom 200 to identify a source of origin.

Product packaging can included with the modular toy loom(s) 100, 200 disclosed herein. Such product packaging may be useful for shipping kits to children in a compact manner prior to first use. The product packaging can completely subsume the modular toy loom(s) 100, 200 and all of the components therein or only encompass a portion thereof. The product packaging will typically include plastics, thermoplastics, glass, wood, wood wool, paper, paperboard, corrugated cardboard, other biodegradable or recyclable materials, or the like. Optionally, the product packaging can include a product identifier 228, such as a word or trade mark, on the product packaging; a viewing window for viewing at least one component and/or the entirety of the modular toy loom(s) 100, 200 or kit on or near the product packaging; instructions for using a part or all of the modular toy loom(s) 100, 200 or kit; a hang tab from which the packaging can hang from shelves in public stores; and/or perforations, folds, pull strings, and/or other elements which facilitate ripping, cutting, and/or opening the product packaging. The product packaging is particularly effective with respect to marketing the product to/for children.

A watertight seal (e.g. gaskets) and/or a heat seal may be established to seal products, packaging, and/or other thermoplastic materials together. Heat seals are particularly effective at joining join similar materials together. Heat sealing is typically performed with uniform thermoplastic monolayers or with materials having several layers, at least one being thermoplastic. In some embodiments, the heat seal is intended to permanently bond two materials together. In other embodiments, the heat seal is designed to break if enough force is applied.

According to some other aspects of the present disclosure, a child may use the toy loom(s) 100, 200 with their friends or to engage social media. For example, children can share with other children the braids of their collection, which may potentially lead to children trading braids and/or other items of their collection to other children for braids and/or other items of other collections.

A person may be broadcasted on a social media platform using the play apparatus and/or play compound that can be extruded through the play apparatus. The social media platform may be accessed through a network. The network could, for example, be a wide area network ("WAN"), a TCP/IP based network, a cellular network, a local area network ("LAN"), a neighborhood area network ("NAN"), a home area network ("HAN"), or a personal area network ("PAN") employing any of a variety of communications protocols, such as Wi-Fi, Bluetooth, ZigBee, near field communication ("NFC"), etc., although other types of networks are possible and are contemplated herein. The network typically allows communication between the communications module and the central location during moments of low-quality connections. Communications through the network can be protected using one or more encryption techniques, such as those techniques provided in the IEEE 802.1 standard for port-based network security, pre-shared key, Extensible Authentication Protocol ("EAP"), Wired Equivalent Privacy ("WEP"), Temporal Key Integrity Protocol ("TKIP"), Wi-Fi Protected Access ("WPA"), and the like.

From the foregoing, it can be seen that the present invention accomplishes at least all of the stated objectives.

LIST OF REFERENCE CHARACTERS

The following table of reference characters and descriptors are not exhaustive, nor limiting, and include reasonable equivalents. If possible, elements identified by a reference character below and/or those elements which are near ubiquitous within the art can replace or supplement any element identified by another reference character.

TABLE 1

| List of Reference Characters | |
|---|---|
| 100 | first exemplary modular toy loom |
| 102 | base |
| 104 | transport members (e.g. fixed, carrying handles) |
| 106 | fixed end |
| 108 | fixed disk |
| 110 | movable end |
| 112 | rotatable disk |
| 114 | input member (e.g. rotatable handles) |
| 116 | center |
| 118 | perimeter |
| 120 | hook |
| 122 | slidable connection(s) (e.g. guided members movable through internal tracks) |
| 124 | notches |
| 126 | engagement mechanism (e.g. retractable pins) |
| 128 | release mechanism(s) (e.g. buttons) |
| 130 | hands of a user |
| 132 | weavable material (e.g, string, thread, yam) |
| 134 | knot |
| 136 | braid |
| 138 | blade |
| 140 | toy accessory |
| 200 | second exemplary modular toy loom |
| 202 | base |
| 202A | cavity |
| 202B | receptacle |
| 204 | support member |
| 206 | first end (e.g. an end near a fixed connection) |
| 208A | first removable insert |
| 208B | third removable insert |
| 210 | second end (e.g. an end near a slidable connection) |
| 212A | second removable insert |
| 212B | fourth removable insert |
| 214 | input member (e.g. rotatable handles) |
| 216 | center |
| 218 | perimeter |
| 220 | hook |
| 222 | slidable connection (e.g. guided members movable through internal tracks) |

TABLE 1-continued

| List of Reference Characters | |
|---|---|
| 224 | divider |
| 226 | peg |
| 228 | source indicator |
| 230 | clips or clasps |

Glossary

Unless defined otherwise, all technical and scientific terms used above have the same meaning as commonly understood by one of ordinary skill in the art to which embodiments of the present invention pertain.

The terms "a," "an," and "the" include both singular and plural referents.

The term "or" is synonymous with "and/or" and means any one member or combination of members of a particular list.

The terms "invention" or "present invention" are not intended to refer to any single embodiment of the particular invention but encompass all possible embodiments as described in the specification and the claims.

The term "about" as used herein refer to slight variations in numerical quantities with respect to any quantifiable variable. Inadvertent error can occur, for example, through use of typical measuring techniques or equipment or from differences in the manufacture, source, or purity of components.

The term "substantially" refers to a great or significant extent. "Substantially" can thus refer to a plurality, majority, and/or a supermajority of said quantifiable variable, given proper context.

The term "generally" encompasses both "about" and "substantially."

The term "configured" describes structure capable of performing a task or adopting a particular configuration. The term "configured" can be used interchangeably with other similar phrases, such as constructed, arranged, adapted, manufactured, and the like.

Terms characterizing sequential order, a position, and/or an orientation are not limiting and are only referenced according to the views presented.

The term "play" can be used herein as an adjective, a verb, a noun, or any other suitable part of speech given proper context. As an adjective, "play" means relating to an activity engaged in for enjoyment and recreation, especially by children. As a verb, "to play" means to engage in a game or activity for enjoyment or recreation. As a noun, "play" means an activity engaged in for enjoyment and recreation.

The present disclosure is further defined by the following numbered paragraphs.

1. A kit comprising:
   a modular toy loom (100/200) comprising:
      a base (102/202) comprising:
         a first end (106/110/206/210);
         a second end (106/110/206/210); and
         a slidable connection (122/222) for expanding and/or retracting at least one dimensional aspect of the base (102/202);
      hooks or pegs (120/220/226) operatively attached to the first end (106/110/206/210) or the second end (106/110/206/210); and
   strings, threads, and/or yarn (132).
2. The kit of claim 1 wherein the base (102) further comprises spaced apart hooks (120) at the first end (106/110); a shared hook (120) at the second end (106/110); and an input member (114) at either the first end (106/110) or second end (106/110) for rotating either the spaced apart hooks (120) or the shared hook (120).

3. The kit of claim 2 wherein the base (102) comprises a first member and a second member; and further wherein guides in the first member are movable through internal tracks in the second member, thereby establishing said slidable connection (122).
4. The kit of claim 1 wherein the base (202) further comprises a cavity (202A) and a receptacle (202B) for receiving removable inserts (208A/208B/212A/212B) at the first end (206/210) and/or second end (206/210).
5. The kit of claim 4 wherein the slidable connection (222) is established between guides in the receptacle (202B) and tracks in the base (202) or tracks in the receptacle (202B) and guides in the base (202).
6. The kit of claim 4 wherein the slidable connection (222) is established between guides in one of the removable inserts (208A/208B/212A/212B) at the first end (206/210) and tracks in the base (202) or tracks in one of the removable inserts (208A/208B/212A/212B) at the first end (206/210) and guides in the base (202).
7. The kit of any one of claims 1-6 further comprising a charm and/or other toy accessory (140).
8. The kit of any one of claims 1-7 wherein the strings, threads, and/or yarn (132) are of at least two distinct colors.
9. The kit of any one of claims 1-8 further comprising a tool for facilitating removal of the strings, threads, and/or yarn (132) from the modular toy loom (100/200), said tool optionally comprising a blade (138).
10. The kit of any one of claims 1-9 further comprising product packaging to house at least some of the components therein.
11. A modular toy loom (200) for making crafts comprising:

a base (202) comprising:
- a receptacle (202B) near a first end (206/210);
- a cavity (202A) recessed from an upper surface of the base (202) near a second end (206/210), said second end (206/210) opposite the first end (206/210); and
- a slidable connection (222) for expanding and/or retracting at least one dimensional aspect of the base (202);

at least four removable inserts (208A/208B/212A/212B), each of the four removable inserts comprising at least one hook (220) or peg (226).

12. The modular toy loom (200) of claim 11 wherein a first removable insert of the at least four removable inserts (208A) comprises annularly spaced apart hooks (220).
13. The modular toy loom (200) of claim 12 wherein the annularly spaced apart hooks (220) are located towards a perimeter (218) of the first removable insert (208A).
14. The modular toy loom (200) of any one of claims 12-13 wherein the annularly spaced apart hooks (220) are symmetrically arrayed about a center (216) of the first removable insert (208A).
15. The modular toy loom (200) of any one of claims 11-14 wherein a second removable insert (212A) of the at least four removable inserts (208A) comprises a central hook (220).
16. The modular toy loom (200) of any one of claims 11-15 further comprising an input member (214) on either the first removable insert (208A) or the second removable insert (212A) for rotating either the spaced apart hooks (220) or the central hook (220).
17. The modular toy loom (200) of any one of claims 11-16 wherein a third removable insert (208B) of the at least four removable inserts (208A) comprises linearly spaced apart pegs (226).
18. The modular toy loom (200) of claim 17 wherein a fourth removable insert (212B) of the at least four removable inserts (208A) comprises linearly spaced apart pegs (226).
19. A modular toy loom (100) for making crafts comprising:

an expandable and retractable base (102) comprising:
- spaced apart hooks (120) at a first end (106/110); and
- a shared hook (120) at a second end (106/110), said second end (106/110) opposite the first end (106/110); and an input member (114) for rotating either the spaced apart hooks (120) or the shared hook (120).

20. The modular toy loom (100) of claim 19 wherein the spaced apart hooks (120) are located towards a perimeter (118) of the first end.
21. The toy loom (100) of any one of claims 19-20 wherein the spaced apart hooks (120) are symmetrically arrayed.
22. The toy loom (100) of any one of claims 19-21 wherein the first end (106) is fixed with respect to the expandable and retractable base (102).
23. The toy loom (100) of claim 22 wherein the first end (106) comprises a removable disk (108), said removable disk (108) fixed in position during operation of the toy loom (100).
24. The toy loom (100) of any one of claims 19-23 wherein at least a portion of the second end (110) is rotatable with respect to the base.
25. The toy loom (100) of any one of claims 19-24 wherein the second end (110) comprises a removable disk (112), said removable disk (112) capable of being rotated during operation of the toy loom (100).
26. The toy loom (100) of any one of claims 19-21 wherein at least a portion of the first end (110) is rotatable with respect to the base (102).
27. The toy loom (100) of any one of claims 19-21 and 26 wherein the first end (110) comprises a removable disk (112), said removable disk (112) capable of being rotated during operation of the toy loom (100).
28. The toy loom (100) of any one of claims 19-21 and 26-27 wherein the second end (106) is fixed with respect to the base (102).
29. The toy loom (100) of any one of claims 19-21 and 26-28 wherein the second end (106) comprises a removable disk (108), said removable disk (108) fixed in position during operation of the toy loom (100).
30. The toy loom (100) of any one of claims 19-29 wherein the shared hook (120) is located at a center (116) of the second end (106).
31. The toy loom (100) of any one of claims 19-30 further comprising guided members (122) slidably connected to an internal track within the expandable and retractable base (102).
32. The toy loom (100) of any one of claims 19-31 wherein the expandable and retractable base (102) can be expanded and/or retracted to pre-set lengths.
33. The toy loom (100) of claim 32 wherein the pre-set lengths are determined by incrementally spaced apart notches (124) in the guided members (122).
34. The toy loom (100) of claim 33 further comprising an engagement mechanism (126) for engaging the notches (124) and retaining the toy loom (100) in positions which correspond with the pre-set lengths, said engagement mechanism (126) located towards an external edge of the extendable and retractable base (102).

35. The toy loom (100) of claim 34 wherein the engagement mechanism (126) comprises a resilient member.
36. The toy loom (100) of claim 35 wherein the resilient member comprises at least one component selected from the group consisting of: (a) a spring; (b) an elastomer; (c) a ratchet and pawl; and (d) an actuator.
37. The toy loom (100) of any one of claims 34-36 further comprising a release mechanism (128) for releasing the engagement mechanism, thereby allowing for further expansion and retraction of the expandable and retractable base (102).
38. The toy loom (100) of claim 37 wherein the release mechanism comprises at least one component selected from the group consisting of: (a) a button; (b) a latch; (c) a lever; and (d) a lock.
39. The toy loom (100) of any one of claims 19-38 wherein the input member (114) is a rotatable handle.
40. The toy loom (100) of any one of claims 19-39 further comprising a transport member (104) attached to the base (102) for carrying the toy loom (100).
41. A method of play and/or forming crafts comprising:
looping strings, threads, and/or yarn (132) around spaced apart hooks (120/220) at a first end (106/110/206/210) of an expandable and retractable base (102/202);
securing the strings, threads, and/or yarn (132) to a shared hook (120/220) at a second end (106/110/206/210) of the expandable and retractable base (102/202); and
forming a braid (136) by rotating the spaced apart hooks (120/220) or the shared hook (120/220).
42. The method of play of claim 41 further comprising adding or subtracting tension from the strings, threads, and/or yarn (132) and/or the braid (136) by adjusting a length of the expandable and retractable base (102/202).
43. The method of any one of claims 41-42 further comprising tying a knot (134) at the first and/or second end (106/110/206/210) of the expandable and retractable base (102/202).
44. The method of any one of claims 41-43 further comprising after the braid (136) is formed, removing the braid (136) from the expandable and retractable base (102/202).
45. The method of claim 44 further comprising forming a bracelet by attaching a first end of the braid (136) to a second end of the braid (136).
46. The method of claim 45 further comprising forming a necklace by repeating steps of the method to form at least two braids (136) and attaching the at least two braids (136) to form a closed loop.
47. The method of any one of claims 45-46 further comprising adding a charm and/or other toy accessory (140) to the bracelet or the necklace.

The "scope" of the present invention is defined by the appended claims, along with the full scope of equivalents to which such claims are entitled. The scope of the invention is further qualified as including any possible modification to any of the aspects and/or embodiments disclosed herein which would result in other embodiments, combinations, subcombinations, or the like that would be obvious to those skilled in the art.

What is claimed is:

1. A kit comprising:
a modular toy loom (100/200) comprising:
a base (102/202) comprising:
a first end (106/110/206/210);
a second end (106/110/206/210);
a slidable connection (122/222) for at least one of expanding and retracting at least one dimensional aspect of the base (102/202); and
a cavity (202A) and a receptacle (202B) for receiving removable inserts (208A/208B/212A/212B) at least one of the first end (206/210) and second end (206/210);
hooks or pegs (120/220/226) operatively attached to the first end (106/110/206/210) or the second end (106/110/206/210);
at least one of strings, threads, and yarn (132); and wherein the slidable connection (222) is established between guides in one of the removable inserts (208A/208B/212A/212B) at the first end (206/210) and tracks in the base (202) or tracks in one of the removable inserts (208A/208B/212A/212B) at the first end (206/210) and guides in the base (202).

2. The kit of claim 1 wherein the base (102) further comprises spaced apart hooks (120) at the first end (106/110); a shared hook (120) at the second end (106/110); and an input member (114) at either the first end (106/110) or second end (106/110) for rotating either the spaced apart hooks (120) or the shared hook (120).

3. The kit of claim 2 wherein the base (102) comprises a first member and a second member; and further wherein guides in the first member are movable through internal tracks in the second member, thereby establishing said slidable connection (122).

4. The kit of claim 1 wherein the slidable connection (222) is established between guides in the receptacle (202B) and tracks in the base (202) or tracks in the receptacle (202B) and guides in the base (202).

5. The kit of claim 1 further comprising at least one of a charm and other toy accessory (140).

6. The kit of claim 1 wherein the at least one of strings, threads, and yarn (132) are of at least two distinct colors.

7. The kit of claim 1 further comprising a tool for facilitating removal of the at least one of strings, threads, and yarn (132) from the modular toy loom (100/200), said tool optionally comprising a blade (138).

8. The kit of claim 1 further comprising product packaging to house at least some components therein.

* * * * *